US012078170B2

(12) United States Patent
Lee et al.

(10) Patent No.: US 12,078,170 B2
(45) **Date of Patent: *Sep. 3, 2024**

(54) SCREW PUMP AND INTEGRATED COOLING MODULE INCLUDING THE SAME

(71) Applicant: COAVIS, Sejong-si (KR)

(72) Inventors: Hyuntae Lee, Sejong-si (KR); Wookeun Lee, Sejong-si (KR); Dongheon Mo, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/366,283

(22) Filed: Aug. 7, 2023

(65) Prior Publication Data

US 2024/0052837 A1 Feb. 15, 2024

(30) Foreign Application Priority Data

Aug. 9, 2022 (KR) ..... 10-2022-0099129

(51) Int. Cl.

| | |
|---|---|
| ***F04C 18/16*** | (2006.01) |
| ***F04C 2/16*** | (2006.01) |
| ***F04C 15/06*** | (2006.01) |
| ***F04C 29/04*** | (2006.01) |

(52) U.S. Cl.

CPC ..... *F04C 18/16* (2013.01); *F04C 2/16* (2013.01); *F04C 15/06* (2013.01); *F04C 29/04* (2013.01); *F04C 2240/30* (2013.01)

(58) Field of Classification Search

CPC ..... F04C 2/16; F04C 15/008; F04C 15/06; F04C 18/16; F04C 29/04; F04C 2240/30; F04C 2240/40

See application file for complete search history.

(56) References Cited

U.S. PATENT DOCUMENTS

| | | | | |
|---|---|---|---|---|
| 2,079,083 | A * | 5/1937 | Montelius | F04C 2/165 418/197 |
| 11,905,957 | B1 * | 2/2024 | Lee | F04C 15/06 |
| 2021/0381510 | A1 * | 12/2021 | Chiba | F04C 29/02 |
| 2022/0344747 | A1 * | 10/2022 | Pawellek | H01M 10/63 |

FOREIGN PATENT DOCUMENTS

| | | | |
|---|---|---|---|
| JP | 2009105384 | A | 5/2009 |
| JP | 2020067064 | A | 4/2020 |
| KR | 102195349 | B1 | 12/2020 |
| KR | 20220043563 | A | 4/2022 |

OTHER PUBLICATIONS

WO2021001402a1—Pawellek—Temperature Control Device for a Battery Bank Module—English Machine Translation. (Year: 2021).*

* cited by examiner

*Primary Examiner* — Theresa Trieu

(74) *Attorney, Agent, or Firm* — McCoy Russell LLP

(57) ABSTRACT

The present disclosure relates to a cooling module in which a plurality of cooling water outlets through which cooling water is discharged are formed in an outer housing, an inner housing into which a first screw and a second screw are inserted inside the outer housing, and a communication hole formed in the inner housing communicates with a plurality of cooling water outlets, in which a cooling module or a cooling water system including a plurality cooling water outlets formed in one screw pump is simple, reduces the number of parts, and simplifies a package.

8 Claims, 10 Drawing Sheets

SCREW PUMP AND INTEGRATED COOLING MODULE INCLUDING THE SAME

CROSS-REFERENCE TO RELATED APPLICATION

This application claims priority under 35 U.S.C. § 119 to Korean Patent Application No. 10-2022-0099129, filed on Aug. 9, 2022, in the Korean Intellectual Property Office, the disclosure of which is incorporated herein by reference in its entirety.

TECHNICAL FIELD

The following disclosure relates to a screw pump for pumping and circulating cooling water in a cooling system of a vehicle and a cooling module including the same.

BACKGROUND

Since electric vehicles travel using motors that are driven by power supplied from batteries or fuel cells, carbon emissions are low and noise is low. In addition, electric vehicles are environmentally friendly because they use motors that are more energy efficient than conventional engines.

Such an electric vehicle includes a thermal management system for cooling electric components such as a heating and cooling and driving motor for indoor air conditioning, a battery, and an inverter.

However, the thermal management system includes a cooling water system for heating an interior of the vehicle and cooling and heating electric components. The cooling water system has many parts for circulation of the cooling water and many pipes connecting the parts, so the process of assembling the cooling water system is complicated and difficult. In addition, since the length of the pipe connecting the parts increases, the loss of efficiency of the system due to the pressure drop of the flowing cooling water increases.

Accordingly, as illustrated in FIG. 1, the conventional vehicle cooling water module includes a plurality of cooling water pumps, a first circulation pump 31 and a second circulation pump 32, and is configured to circulate cooling water in a cooling line passing through a battery using the first circulation pump 31 and circulate cooling water in a cooling line passing through battery electronic components using the second circulation pump 32. In addition, the first circulation pump 31, the second circulation pump 32, a reservoir tank 10, and a valve 20 capable of controlling the cooling water connection between components are configured as an integral module to simplify the cooling water system.

Here, a centrifugal pump is generally used as a cooling water pump for pumping cooling water. Conventionally, a plurality of cooling water pumps are used to satisfy the performance, efficiency, size, noise, and the like of the cooling water pump. In addition, each of the cooling water pumps has only one cooling water outlet through which the cooling water is discharged. Therefore, since the cooling water system also uses a plurality of cooling water pumps, pipes connecting parts are long and complicated, and a loss of system efficiency occurs due to a pressure drop of the cooling water.

RELATED ART DOCUMENT

Patent Document

KR 10-2022-0043563 A (Apr. 5, 2022) "Cooling Water Module for Vehicle"

SUMMARY

An embodiment of the present disclosure is directed to providing a screw pump having a plurality of cooling water outlets, and a cooling module capable of reducing the number of parts and simplifying a package while simplifying a configuration, including the same.

In one general aspect, a screw pump includes: an outer housing that is formed in a form of a container with one side open, and has a cooling water inlet communicating with an internal space on the other side and a plurality of cooling water outlets communicating with an internal space and discharging cooling water on one side surface; an inner housing that is formed in a form of a container with the other side open, has a communication hole communicating an inside and an outside on one side, and is inserted into the outer housing so that the communication hole communicates with the plurality of cooling water outlets; a thrust key that is inserted into and coupled to the other inner end of the outer housing; and a first screw and a second screw that are inserted into the inner housing, have lower ends supported by the thrust key, and are rotatably engaged with each other.

The communication hole of the inner housing may be formed in plural, and the plurality of communication holes may be spaced apart from each other along a circumference of one side of the inner housing and formed toward one side and a side surface.

The outer housing may be formed with an expansion part in a form in which the internal space is expanded at one end of a side wall, and the inner housing may be formed so that a ring part inserted corresponding to the expansion part of the outer housing is spaced apart from one end of the body inserted into the side wall of the outer housing, and one end of the body and the ring part are connected by a plurality of ribs.

The plurality of ribs may be formed to protrude from the other surface of the ring part, and the plurality of ribs may be spaced apart from each other in a circumferential direction.

The plurality of cooling water outlets may be connected to at least one of a side surface and a bottom of the expansion part.

A plurality of supports may be formed to extend from the inside of the ring part toward a center in the radial direction, and a drive shaft support part rotatably supported by inserting a drive shaft connected to the first screw into the center in the radial direction where the supports meet may be formed.

The drive shaft may further include a driving unit that penetrates through the drive shaft support part to be coupled to the first screw and is coupled to the outer housing to block an open side.

The second screw may be provided in plural.

In another general aspect, a cooling module including a screw pump includes: a reservoir tank in which cooling water is stored; the screw pump coupled to the reservoir tank and having a cooling water inlet communicating with the reservoir tank to pump cooling water; and a direction changeover valve that is coupled to the reservoir tank, has an outlet port communicating with the reservoir tank, and has a plurality of inlet ports to change a flow direction of the cooling water according to operation.

| [Detailed Description of Main Elements] | |
|---|---|
| 1000: Screw pump | |
| 100: Outer housing | 101: Side wall |
| 102: Expansion part | |
| 110: Cooling water inlet | |
| 120: Cooling water outlet | |
| 200: Inner housing | 201: Body |
| 202: Ring part | 210: Rib |
| 220: Communication hole | 230: Support |
| 240: Drive shaft support part | |
| 300: Thrust key | |
| 410: First screw | 420: Second screw |
| 430: Coupling | |
| 500: Driving unit | 510: Drive shaft |
| 2000: Reservoir tank | |
| 3000: Direction changeover valve | |

DETAILED DESCRIPTION OF EMBODIMENTS

Hereinafter, a screw pump and a cooling module including the same according to the present disclosure will be described in detail with reference to the accompanying drawings.

Figure 1:
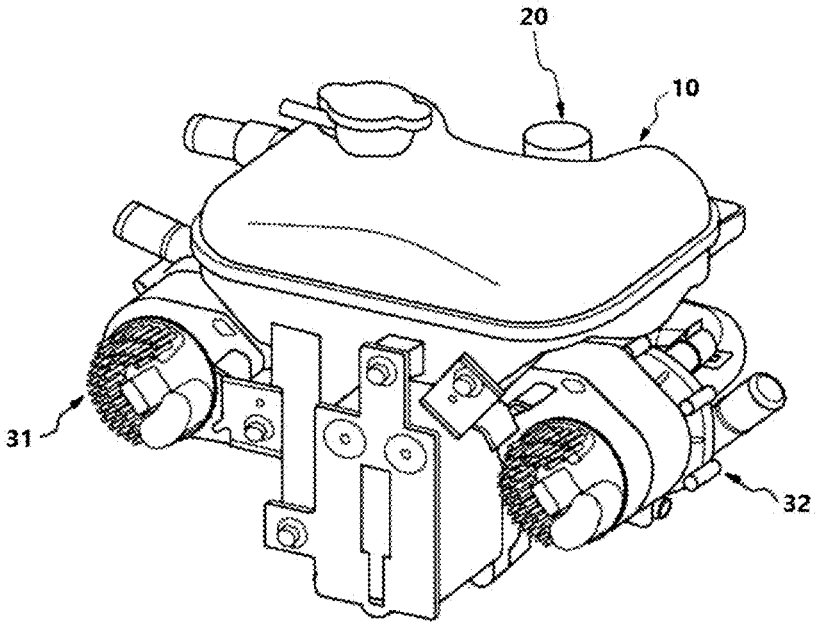
FIG. 1 Prior Art
FIG. 1 is a perspective view illustrating a conventional vehicle cooling water module and a cooling water pump.
Figure 2:
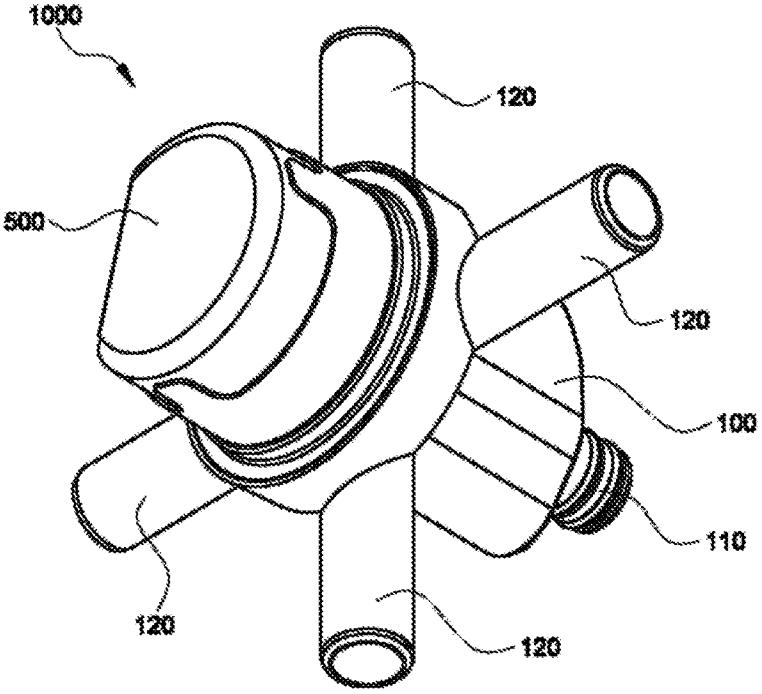
FIGS. 2 to 4 are an assembled perspective view, an exploded perspective view, and a front cross-sectional view illustrating a screw pump according to an embodiment of the present disclosure.
Figure 3:
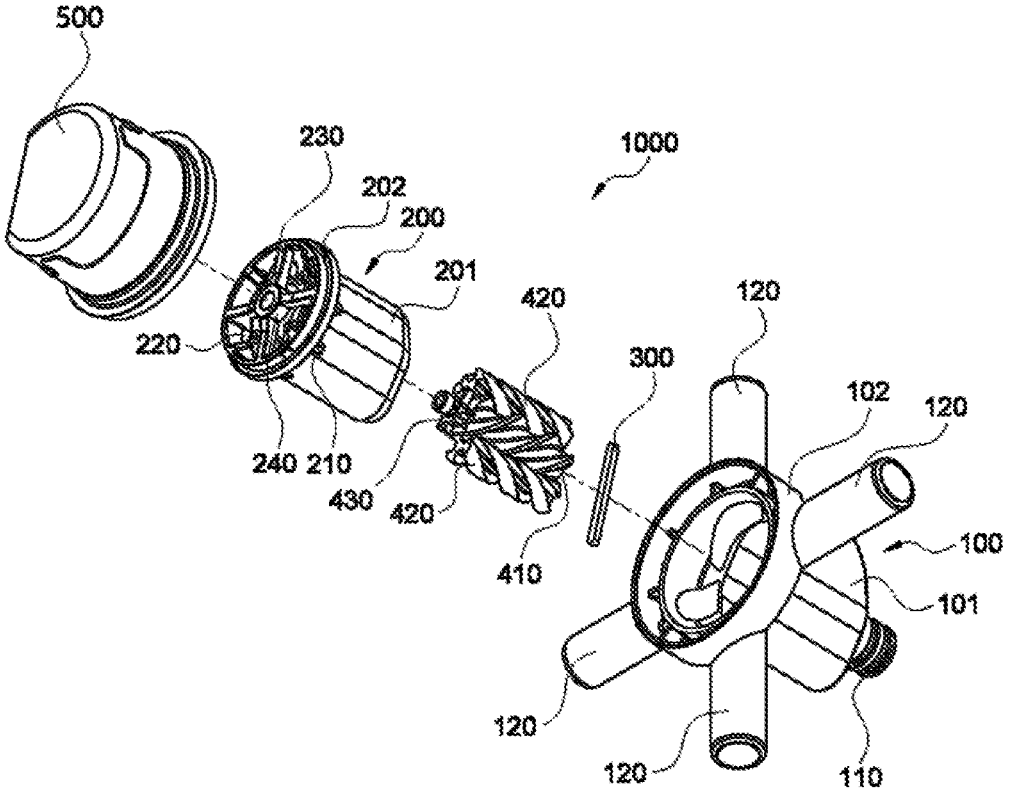
Figure 4:
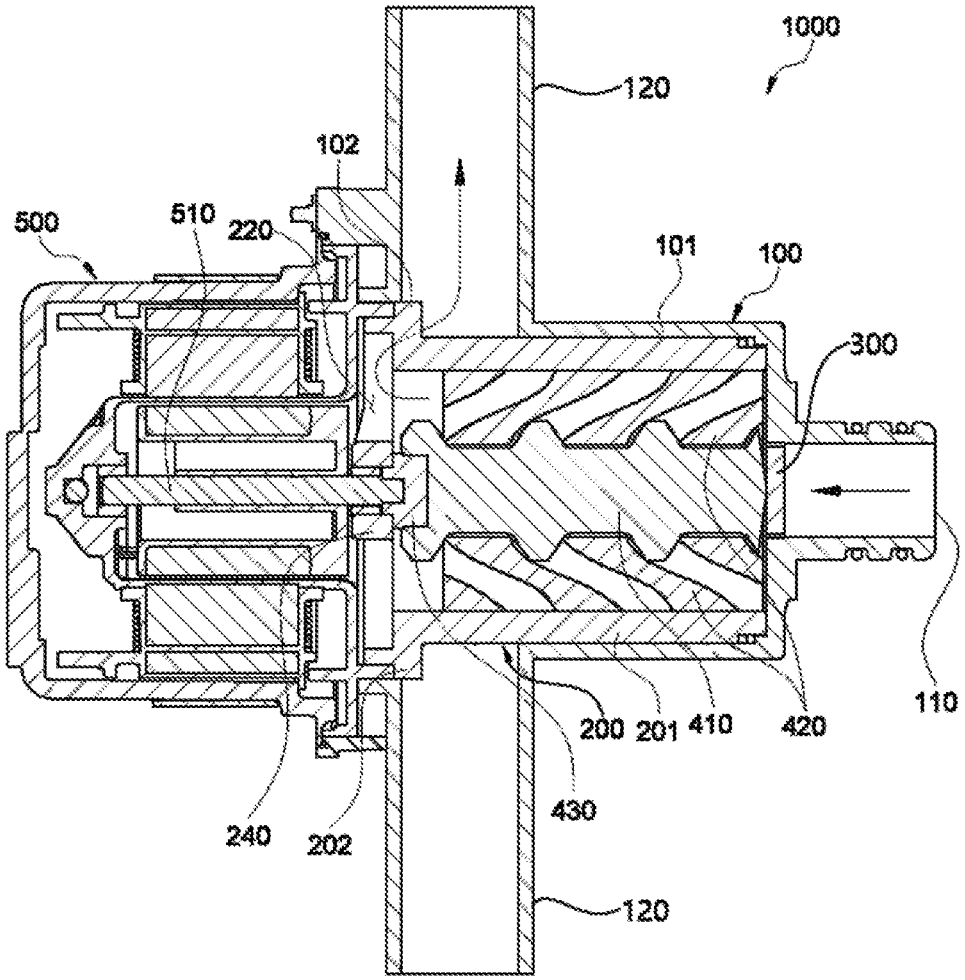
Figure 5:
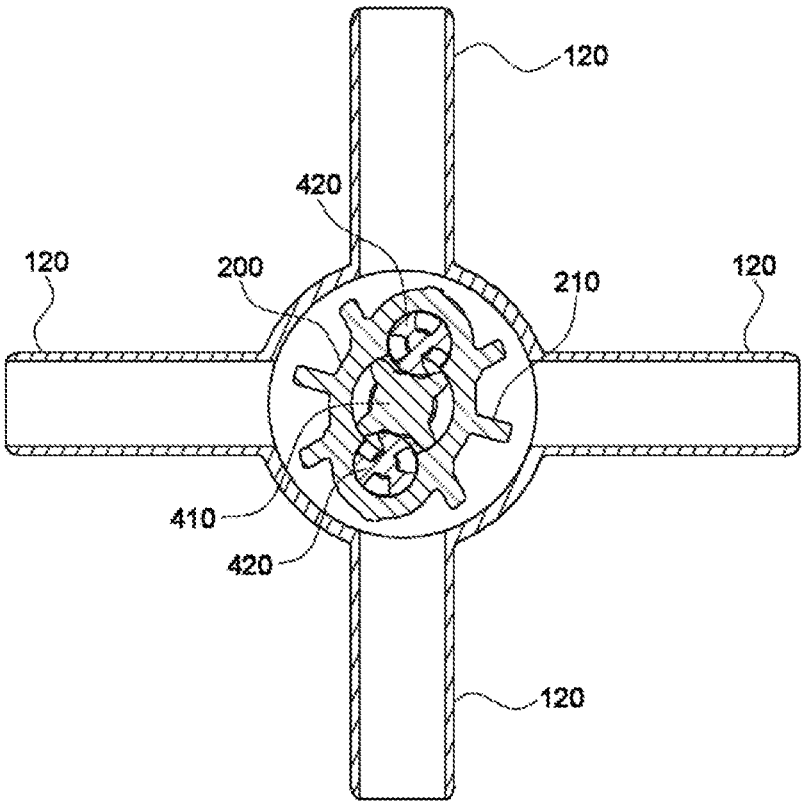
FIG. 5 is a cross-sectional view illustrating a cooling water outlet part of the screw pump according to the embodiment of the present disclosure.
Figure 6:
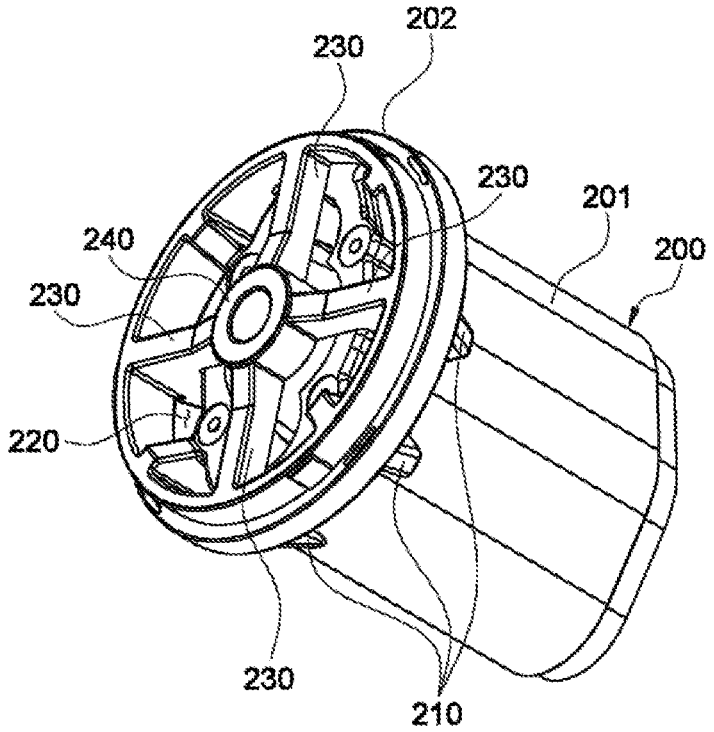
FIGS. 6 to 8 are a perspective view and a plan view illustrating an inner housing of the screw pump according to the embodiment of the present disclosure.
Figure 7:
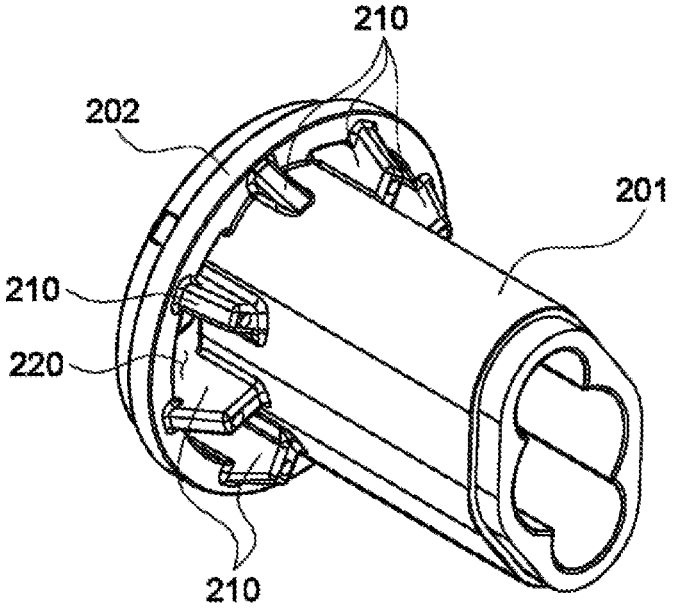
Figure 8:
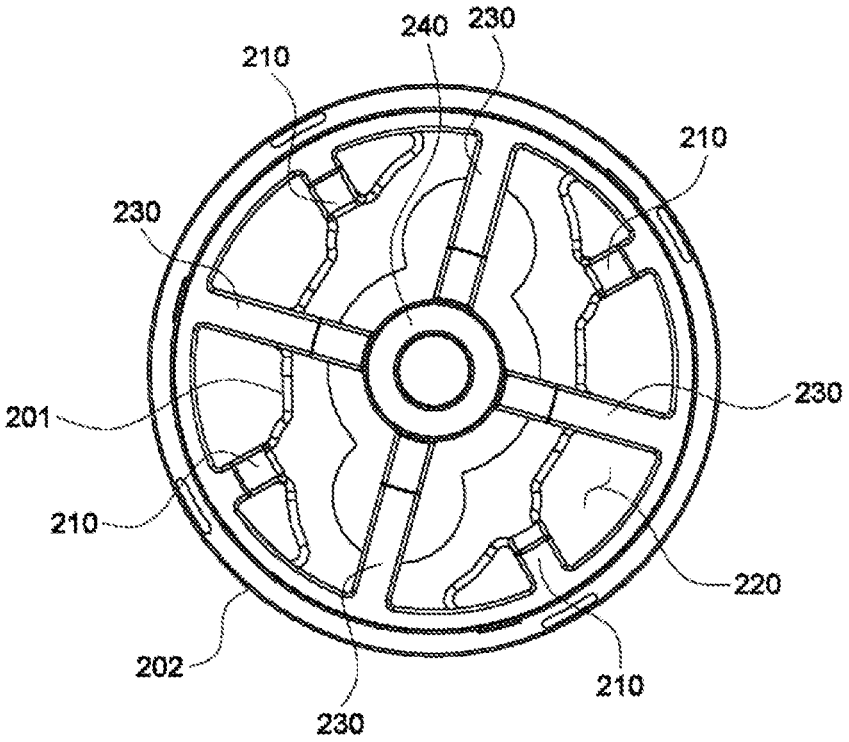
Figure 9:
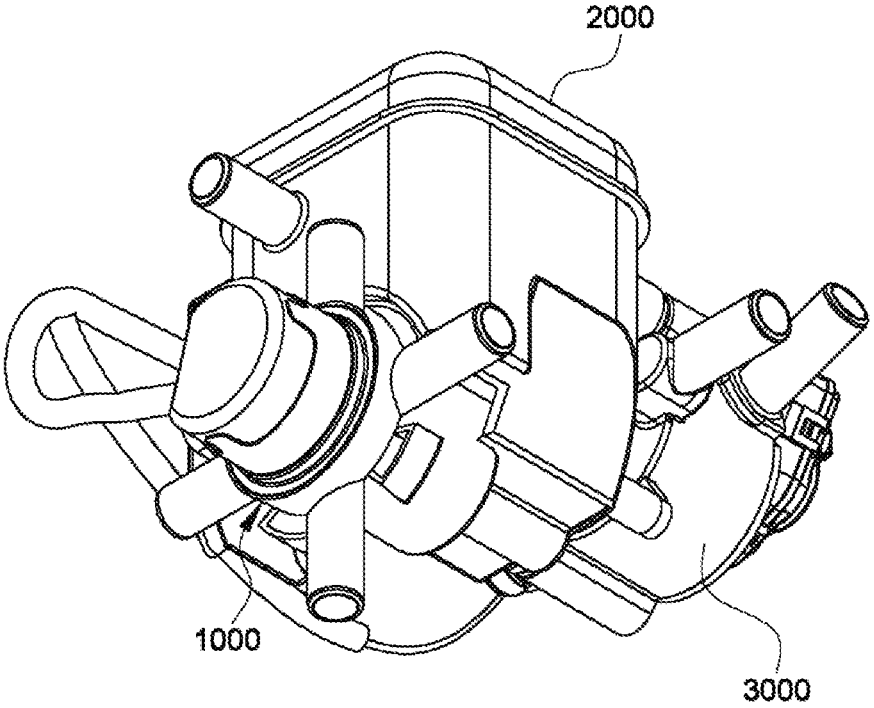
FIGS. 9 and 10 are an assembled perspective view and a front cross-sectional view illustrating cooling module including a screw pump according to an embodiment of the present disclosure.
Figure 10:
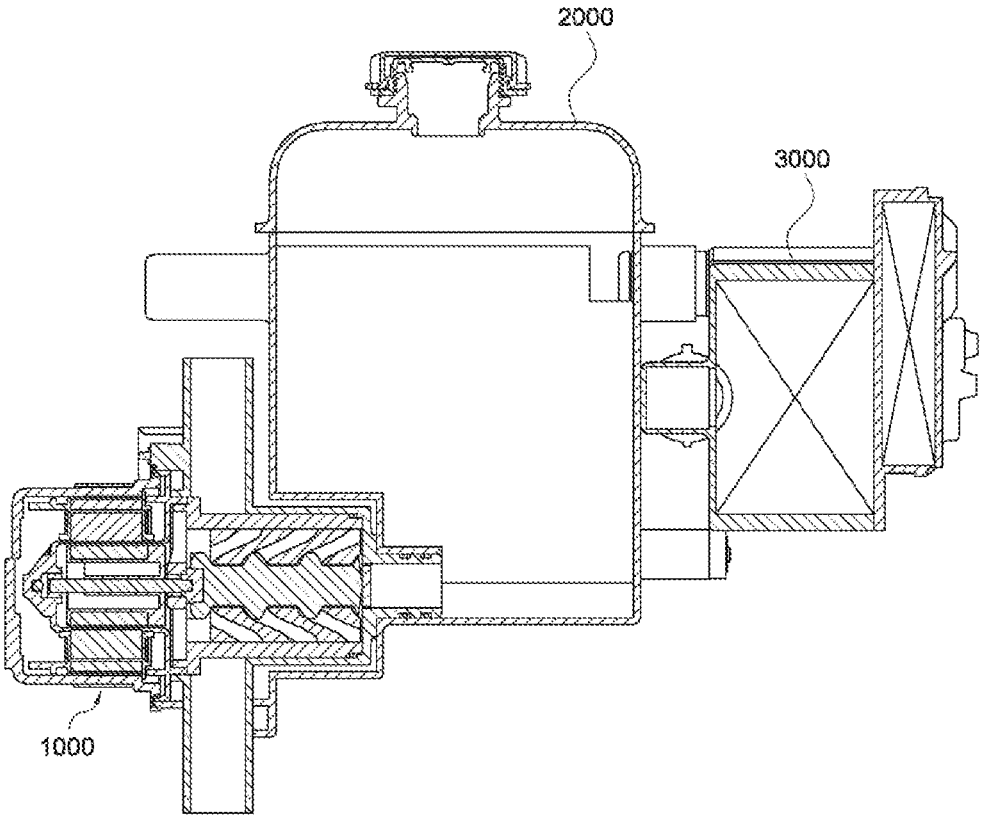

FIGS. 2 to 4 are an assembled perspective view, an exploded perspective view, and a front cross-sectional view illustrating a screw pump according to an embodiment of the present disclosure, FIG. 5 is a cross-sectional view illustrating a cooling water outlet part of the screw pump according to the embodiment of the present disclosure, and FIGS. 6 to 8 are a perspective view and a plan view illustrating an inner housing of the screw pump according to the embodiment of the present disclosure.

As illustrated, a screw pump 1000 according to one embodiment of the present disclosure may include an outer housing 100, an inner housing 200, a thrust key 300, a first screw 410, and a second screw 420. The screw pump according to an embodiment of the present disclosure may further include a driving unit 500.

The outer housing 100 may be formed in the form of a container with one side open. For example, the outer housing 100 may be a form in which one side is open and the other side is closed except for the cooling water inlet 110 in the pipe-shaped side wall 101 with an empty space inside, in which the other side may be provided with a cooling water inlet 110 communicating with an internal space surrounded by the side wall 101. In addition, an expansion part 102 may be formed at one end of the side wall 101 in a form in which the internal space is expanded. In addition, a plurality of cooling water outlets 120 through which cooling water is discharged may be formed in the outer housing 100, and each cooling water outlet 120 may be connected to at least one of a side surface and a bottom of the expansion part 102. For example, in the drawings, four cooling water outlets 120 are arranged at 90 degree intervals along a circumferential direction and extend radially, but the cooling water outlet 120 may be formed in various forms.

The inner housing 200 may be formed in a form of a container with the other side open. For example, the inner housing 200 may be a form in which the other side is open, and one side is partially closed by a plurality of supports 230 and a drive shaft support part 240 in a pipe-shaped body 201 with an empty space inside. Also, an opening is formed between the plurality of supports 230 so that the inside and outside of the body 201 may be communicated through the opening. In addition, the inside of the body 201 may be formed to correspond to the form in which the first screw 410 and the second screw 420 are engaged with each other. In the inner housing 200, ring parts 202 may be formed to be spaced apart from one end of the body 201, and a portion of the ring part 202 may be coupled to one end of the body 201. In addition, the body 201 and the ring part 202 may be connected to each other by a plurality of ribs 210 at a portion where the ring part 202 is spaced apart from one end of the body 201. Here, the plurality of ribs 210 and the plurality of supports 230 may be spaced apart from each other along the circumferential direction, and the plurality of ribs 210 and the plurality of supports 230 may extend in the form in which they protrude from the other surface of the ring part 202 to the other side. In addition, one side of the inner housing 200 may be provided with a communication hole 220 that communicates the inside and outside of the inner housing 200, and the communication hole 220 may be a space formed between one end of the body 201, the support 230, and the rib 210. The body 201 of the inner housing 200 may be inserted from one open side of the outer housing 100 to the other side, and the other end of the inner housing 200 may be supported by touching the bottom, which is the other closed side of the outer housing 100. In addition, the ring part 202 of the inner housing 200 may be inserted into the expansion part 102 of the outer housing 100, and the plurality of ribs 210 and the plurality of supports 230 may be supported by touching the bottom of the expansion part 102. In addition, the drive shaft support part 240 may be formed in the center of the plurality of supports 230 extending from the inside of the ring part 202 toward the center in the radial direction, and a hole penetrated from one side to the other side may be formed in the drive shaft support part 240 and thus a drive shaft 510 may be inserted into the hole and supported rotatably.

The thrust key 300 may be inserted into and fixed to a key insertion groove recessed on the bottom of the outer housing 100. The thrust key 300 serves to support the other ends of the first screw 410 and the second screw 420, and the first screw 410 and the second screw 420 may smoothly rotate while supported by the thrust key 300. For example, the thrust key 300 may be formed in a rectangular bar shape having a rectangular cross section and having a length greater than the thickness and width.

The first screw 410 may be a male screw in which a spiral protrusion protrudes along an outer circumferential surface of the rotating shaft. One end of the first screw 410 may be coupled to the drive shaft 510 of the driving unit 500, and the first screw 410 and the drive shaft 510 may be coupled to each other through a coupling 430 and the like, so the drive shaft 510 and the first screw 410 may be configured to rotate together.

The second screw 420 may be a female screw having a spiral groove formed along the outer circumferential surface of the rotating shaft, and the spiral groove of the second screw 420 may be formed in a shape corresponding to the spiral protrusion of the first screw 410, so the first screw 410 and the second screw 420 are engaged and rotated together. For example, although the drawings illustrate that the second screw 420 is formed in plural, the number of second screws 420 may be one or more. Thus, the first screw 410 and the second screw 420 may be inserted into the body 201 of the inner housing 200 in a state of being engaged with each other to form an assembly. In addition, this assembly may be inserted into the outer housing 100 and assembled.

The driving unit 500 may be, for example, a motor, and the driving unit 500 may be coupled to the outer housing 100 to cover and close one open side of the outer housing 100. Also, the drive shaft 510 of the driving unit 500 may penetrate through the drive shaft support part 240 of the drive shaft inner housing 200 and be coupled to the first screw 410.

Accordingly, when the driving unit 500 operates and the drive shaft 510 rotates, the first screw 410 and the second screw 420 connected thereto rotate to pump a fluid under pressure. The cooling water sucked through the cooling water inlet 110 may flow between the first screw 410 and the second screw 420 toward the communication hole 220 of the inner housing 200, and then, may be delivered to the outside through the cooling water outlet 120. In this case, since the inside of the inner housing 200 provided with the first screw 410 and the second screw 420 communicates with the plurality of cooling water outlets 120 through the communication hole 220, the cooling water may be pumped in various directions. In addition, even if the plurality of cooling water outlets 120 are formed, the cooling water may be uniformly pumped through the plurality of cooling water outlets 120 without decreasing the pressure and flow rate of the cooling water delivered to the specific cooling water outlets 120.

Accordingly, the screw pump of the present disclosure may easily form a plurality of outlets in the outer housing without a configuration such as a separate manifold, so the structure may be simple, the number of parts may be reduced in the cooling module or cooling water system including the screw pump, and the package may be simplified.

In addition, the cooling module of the present disclosure may include a reservoir tank 2000, the screw pump 1000, and a direction changeover valve 3000, and may further include a controller.

The reservoir tank 2000 may store cooling water and supply cooling water to the screw pump 1000. An empty space may be formed in the reservoir tank 100 to store cooling water therein, a cooling water inlet is formed on the upper surface of the reservoir tank 100, and a pressure cap is coupled to the cooling water inlet, so the pressure inside the reservoir tank 2000 may be adjusted by the pressure cap. In addition, the reservoir tank 2000 may have a cooling water inlet so that cooling water may flow from a radiator or the like, and a reservoir tank 2000 may be formed with a communication hole that communicates with the outlet port of the direction changeover valve 3000 and in which the cooling water may flow. Here, the reservoir tank 2000 is composed of a single communication space without a partition wall dividing the internal space, so the cooling water may be accommodated in a single space without the cooling water being separately accommodated inside the reservoir tank 2000.

The screw pump 1000 may receive cooling water from the reservoir tank 2000 and pump the cooling water to a required location, and only one screw pump 1000 may be provided. Further, the screw pump 1000 is a pump that pumps a fluid by a volume change between the screws while a plurality of screws are engaged and rotate. The screw pump 1000 is disposed and coupled to the bottom of one side of the reservoir tank 2000, and the cooling water inlet 110 of the screw pump 1000 is connected to the reservoir tank 2000, so the cooling water inside the reservoir tank 2000 may flow smoothly toward the screw pump 1000. Here, the reservoir tank 2000 is provided with a pump mounting part recessed on the lower side, and a portion of the screw pump 1000 may be inserted into and coupled to the pump mounting part. Thus, since the cooling water inlet 110 of the screw pump 1000 is disposed and connected to the cooling water outlet disposed at the lowermost end in the direction of gravity of the reservoir tank 2000, the cooling water may smoothly flow in the screw pump 1000.

The direction changeover valve 3000 is a valve that may change a flow direction of cooling water according to operation. The direction changeover valve 3000 may be coupled to the reservoir tank 2000 and have an outlet port connected to the reservoir tank 2000 to be in communication. In addition, the outlet port of the direction changeover valve 3000 may be connected to the reservoir tank 2000. In addition, the direction changeover valve 3000 may be provided with a plurality of inlet ports, and the inlet port may serve as both an inlet and an outlet according to the operation of the direction changeover valve 3000.

The controller may be connected to the screw pump 1000 and the direction changeover valve 3000 by a cable to control respective operations. In addition, the controller may be coupled to the reservoir tank 2000.

According to a screw pump and a cooling module including the same of the present disclosure, it is possible to reduce the number of parts and simplify a package while simplifying a configuration in a cooling module or a cooling water system by forming a plurality of cooling water outlets in one screw pump.

The present disclosure is not limited to the abovementioned embodiments, but may be variously applied. In addition, the present disclosure may be variously modified by those skilled in the art to which the present disclosure pertains without departing from the gist of the present disclosure claimed in the claims.

What is claimed is:

1. A screw pump, comprising:

an outer housing that is formed in a form of a container with one side open, and has a cooling water inlet communicating with an internal space on the other side and a plurality of cooling water outlets communicating with the internal space and discharging cooling water on one side surface;

an inner housing that is formed in a form of a container with the other side open, has a communication hole communicating an inside of the inner housing and an outside of the inner housing on one side, and is inserted into the outer housing so that the communication hole communicates with the plurality of cooling water outlets;

a thrust key that is inserted into and coupled to the other inner end of the outer housing; and a first screw and a second screw that are inserted into the inner housing, have lower ends supported by the thrust key, and are rotatably engaged with each other, wherein the outer housing is formed with an expansion part in a form in which the internal space is expanded at one end of a side wall, and the inner housing is formed such that a ring part inserted corresponding to the expansion part of the outer housing is spaced apart from one end of a body inserted into the side wall of the outer housing, and one end of the body and the ring part are connected by a plurality of ribs.

2. The screw pump of claim 1, wherein the communication hole of the inner housing is formed in plural, and the plurality of communication holes are spaced apart from each other along a circumference of one side of the inner housing and formed toward one side and a side surface.

3. The screw pump of claim 1, wherein the plurality of ribs are formed to protrude from the other surface of the ring part, and the plurality of ribs are spaced apart from each other in a circumferential direction.

4. The screw pump of claim 3, wherein the plurality of cooling water outlets are connected to at least one of a side surface and a bottom of the expansion part.

5. The screw pump of claim 1, wherein a plurality of supports are formed to extend from the inside of the ring part toward a center of the ring part in the radial direction, and a drive shaft support part rotatably supported by inserting a drive shaft connected to the first screw into the center in the radial direction where the plurality of supports meet is formed.

6. The screw pump of claim 5, wherein the drive shaft further includes a driving part that penetrates through the drive shaft support part to be coupled to the first screw and is coupled to the outer housing to block an open side.

7. The screw pump of claim 1, wherein the second screw is provided in plural.

8. A cooling module, comprising:

a reservoir tank in which cooling water is stored;

the screw pump of claim 1 coupled to the reservoir tank and having a cooling water inlet communicating with the reservoir tank to pump cooling water; and a direction changeover valve that is coupled to the reservoir tank to change a flow direction of the cooling water according to operation.

* * * * *